US007157635B2

(12) United States Patent
Sogabe

(10) Patent No.: US 7,157,635 B2
(45) Date of Patent: Jan. 2, 2007

(54) THUMB PICK FOR GUITAR

(75) Inventor: Hiroshi Sogabe, Chiba (JP)

(73) Assignee: Shinjo Co., Ltd., Chiba (JP)

( * ) Notice: Subject to any disclaimer, the term of this patent is extended or adjusted under 35 U.S.C. 154(b) by 0 days.

(21) Appl. No.: 10/770,508

(22) Filed: Feb. 4, 2004

(65) Prior Publication Data

US 2004/0237754 A1 Dec. 2, 2004

(30) Foreign Application Priority Data

May 30, 2003 (JP) ..... 2003-154385

(51) Int. Cl.
*G10D 3/16* (2006.01)

(52) U.S. Cl. ..... 84/320

(58) Field of Classification Search ..... 84/320–322
See application file for complete search history.

(56) References Cited

U.S. PATENT DOCUMENTS

| | | | | |
|---|---|---|---|---|
| 4,102,234 | A * | 7/1978 | Brundage | 84/322 |
| 4,867,032 | A * | 9/1989 | Lukehart | 84/322 |
| 5,837,913 | A * | 11/1998 | Newman | 84/329 |
| 6,797,871 | B1 * | 9/2004 | Atkin | 84/322 |

FOREIGN PATENT DOCUMENTS

| | | | |
|---|---|---|---|
| JP | 54-151326 | | 10/1979 |
| JP | 2002-041031 | | 2/2002 |
| JP | 2003150156 | A * | 5/2003 |

OTHER PUBLICATIONS

English Language claims of JP 54-131526.
English Language Abstract JP 2002-041031.

* cited by examiner

*Primary Examiner*—Kimberly Lockett
(74) *Attorney, Agent, or Firm*—Greenblum & Bernstein, P.L.C.

(57) ABSTRACT

A thumb pick comprises a pick body for a guitar and a belt body which fixes the pick body to a finger. The pick body is extended integrally with a protruding portion for picking the strings from a base end portion made into contact with the thumb. The belt body is separately formed from the belt body. Both end portions of the belt body is adjustably connected to the pick body. There is provided a cut bent from the protruding portion to the base end portion of the pick body, a substantially tongue-like connecting piece is formed within the cut, and the connecting piece and the one end portion of the belt body 2 are detachably connected. with such construction, a disadvantage of displacing the position of the thumb pick by heat generation and perspiration of the fingers during a performance is solved, and picking suitable for each kind of performing method becomes possible.

8 Claims, 2 Drawing Sheets

THUMB PICK FOR GUITAR

FIELD OF THE INVENTION

The present invention relates to a thumb pick put on the thumb and used when playing a guitar.

DESCRIPTION OF PRIOR ART

A thumb pick used for playing a guitar is, for example, used for base running rendition, three finger rendition, and also for five-stringed banjo, resonator guitar, steel guitar and the like. As the quality of the thumb pick, use is made of plastics such as celluloid or the like, metal, tortoiseshell or the like.

A conventional thumb pick is made by integrally forming a nail portion for touching the strings and a fixed portion for winding round the thumb. Therefore, the thumb pick is disadvantageously displaced due to heat generation and perspiration of fingers at the time of playing. Further, as the size fitted to the finger is selected from ready-made thumb picks for use, a little bit tight thumb pick is used for not slipping out of the finger, and the ready-made thumb pick sometimes hurts the finger. Therefore, a thumb pick having the structure of winding round and fixed to the finger is proposed in Japanese Utility Model Publication No. 54-151326.

Such thumb pick is provided with two large and small picks on both sides of a belt, and an entry for inserting one end portion of the belt is provided at the other end portion of the belt, and at the time of use, one end of the belt wound round the thumb is inserted into the entry, and a protrusion protruded on the side face of the belt is engaged to the entry and fitted. Such thumb pick is, as described above, integrally formed with a pick for touching strings and a belt wound round the thumb, and the pick and the belt are of the same quality.

As a result, the preferable quality as a pick for twanging the strings cannot be different from that as a belt. For example, the preferable material as a pick should have hard and strong quality such as celluloid, metal, tortoiseshell or the like for twanging the strings. On the other hand, the preferable material as a belt should have soft quality for winding round the thumb. Thus, the preferable qualities of the pick and the belt are functionally contrary to each other, so that when a pick and a belt are formed with the same material, a material which is suitable for one is selected or a material which compromises both functions to some extent is selected.

The material which compromises both functions means in a sense that both functions are lowered.

Further, when the belt wound round the thumb is fitted to the base end portion of the protruded pick, resilience of the pick is damaged, and a proper amount of resilience of the thumb pick used for a long time cannot obtained. That is, the protruded pick is continuously formed to a base end portion of the pick, and the base end portion is integrated with the protruded pick for widely adjusting resilience of the pick.

However, if the base end portion of the protruded pick is fitted by the belt, resilience of the base end portion is not transmitted, resilience as usual is lost, and convenient use is extremely worsened.

Further, as an excess shock is added to the finger with the thumb pick, there is the possibility of anxiety of hurting the finger.

Further, after passing through the entry provided at the base end portion of the pick, the belt is kept by winding round the side face of the thumb. However, at the thumb pick, the base end portion is an important portion for first picking operation for making contact with the strings together with adjustment of resilience of the pick. That is, in order to tough the strings with the thumb pick by vibration, first, there is an action of touching the strings with the tip of the pick after depressing the strings at the base end portion of the pick. In this case, if the face of the base end portion does not flat, a guitar cannot be well controlled, and the so-called quailing sound is generated. This kind of sound should not be generated as possible by a performing method, or becomes necessary sound to some extent, so that control of the strings by the base end portion of the pick is extremely important. Therefore, if the belt is wound round the end base portion of the pick, vibration of strings cannot be controlled at all, and there arises such a problem that the use as a thumb pick of a guitar is extremely difficult.

On the other hand, JP 2002-41031 discloses a belt type Koto plectrum. This belt type Koto plectrum is provided with a belt having adjustable belt for winding round a finger, and a non-slipping pocket is provide inside of the belt, and Koto is played by inserting the root portion of a fingernail tip into the pocket. According to this belt type Koto plectrum, the plectrum is not off or loosened during performance, and there is such an advantage that angle and depth of fitting the plectrum freely and easily.

As this belt type Koto plectrum is formed with a belt and a nail piece as separate bodies, it is possible to select the material suitable for respective functions. However, the Koto plectrum is used, in case of putting it on three of the thumb, by opposing to the first finger and the middle finger of real nails, respectively.

Therefore, the Koto plectrum and the thumb pick are entirely different from each other in basic construction, and it is a problem that the belt type plectrum cannot be used as a thumb pick.

SUMMARY OF THE INVENTION

Now, the present invention is created for settling the above problems inherent to the conventional technique, and an object thereof is to solve such disadvantage that the position of a thumb pick is displaced by heat generation, perspiration and the like of fingers during performance, and to provide a thumb pick for a guitar by making the optimum picking for each kind of performing styles of the guitar.

The thumb pick for a guitar of the present invention is characterized by comprising a pick body and a belt body for fitting the pick body to a finger, wherein the pick body is integrally extended from the base end portion made in contact with the thumb to the protruded portion for picking the strings, the belt body and the pick body are formed as separate bodies, and both end portions of the belt body are adjustably connected to the pick body.

In the above thumb pick for a guitar, it is preferable to provide a cut bent from the protruded portion to the base end portion of the pick body, to form a substantially tongue-like connecting piece on the inside of the cut, and to detachably connect the connecting piece to one end portion of the belt body.

Further, it is preferable to form a bent portion at the end of the base end portion of the pick body along the side face of the thumb, to provide an engaging protrusion protruded from the end portion of the bent portion, and to adjustably connect the end portion of the belt body to the engaging protrusion.

According to the thumb pick of the present invention, the pick body fixed to the belt body can be used without damaging resilience between the protruded portion and the base end portion, and the strings can freely be controlled by the base end portion.

DETAILED DESCRIPTION OF PREFERRED EMBODIMENT

An embodiment of the thumb pick for a guitar according to the present invention is explained by referring to the accompanying drawings.

Figure 1:
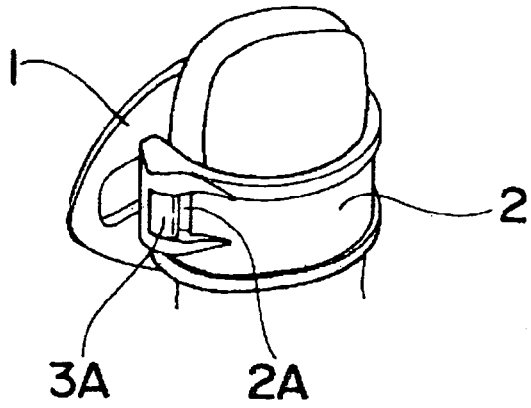
FIG. 1 is a perspective view of the mounting condition showing an example of the thumb pick for a guitar according to the present invention.

As shown in FIG. 1, the thumb pick comprises a pick body 1 of the material suitable for the strings of a guitar and a belt body 2 for fixing the pick body 1 to the thumb. The material of the pick body is properly selected from plastics hitherto used as conventional thumb picks, metals, tortoiseshell and the like. On the other hand, the material of the belt body is preferably soft, heat-resistant and adaptable to fingers such as silicon resin, nylon and the like, but it is also possible to select the other material such as natural materials such as leather and the like.

Figure 2:
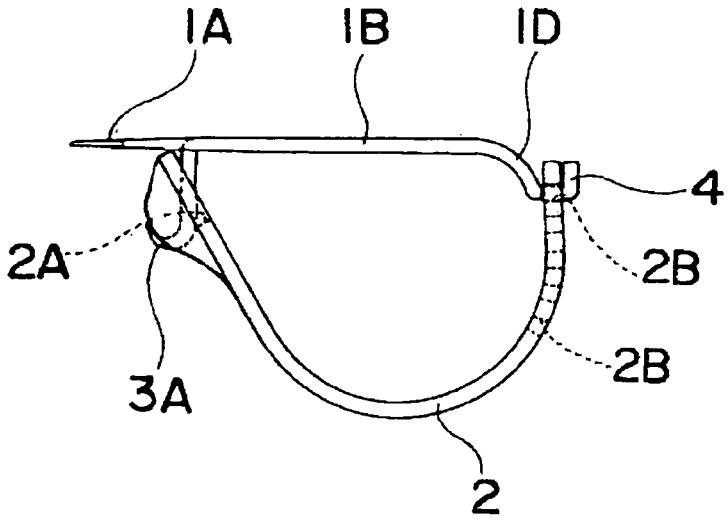
FIG. 2 is a side view of the thumb pick for a guitar as well.

The pick body 1 has, as shown in FIG. 2, a fundamentally flat face as an operating face, and a base end portion 1B made into contact with the thumb is integrally connected to a protruded portion 1A for picking the strings. Further, there is provided a cut 1C bent from the protruded portion 1A to the base end portion 1B of the pick body.

Figure 3:
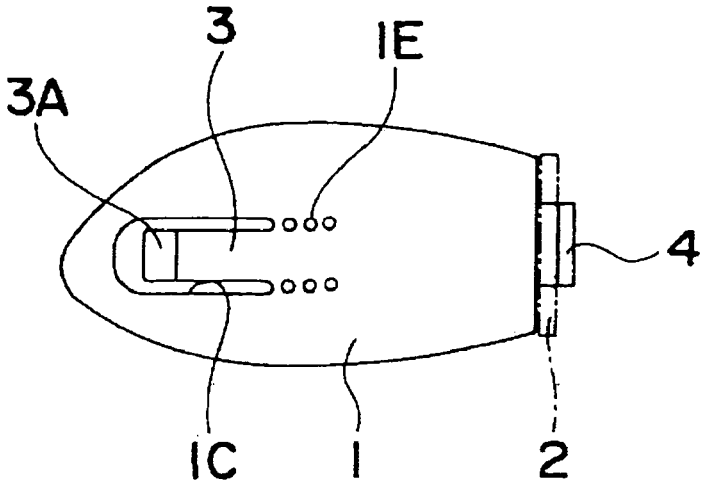
FIG. 3 is a plan view of the pick body.

A substantially tongue-like connecting piece 3 is formed on the inside of the cut 1C, and to this connecting piece 3 is connected the end portion of the belt body 2 (see FIGS. 2 and 3). The cut 1C is for adjusting resilience of the pick body, forming a substantially horseshoe shape by extending an open end portion from the bent portion adjacent to the protruded portion 1A to the direction of the base end portion, and therefore, the longer the cut is formed along the longitudinal of the pick body 1, the more soft resilience is obtained. The cut 1C can optionally be changed such as a substantial U-shape, <-shape and the like other than the substantial horseshoe shape of the illustrated example. Even in either case, the open end portion of the bent cut 1C is formed to direct to the direction of the base end portion 1B. Further, the shape of the connecting piece 3 also becomes a tongue shape along the shape of the cut 1C. It is further possible to form the cut 1C and the connecting piece 3 by changing their shapes.

In the cut 1C is juxtaposed a cut auxiliary line 1E at the open end portion of the cut 1C for adjusting resilience in reply to each player's preference as shown in FIG. 3. The cut auxiliary line 1E is formed with a plurality of perforations in substantially sewing seams, and the player himself can extend the cut 1C along the cut auxiliary line 1E. It is further possible to provide the cut auxiliary line 1E by making the pick body 1 thin. The connecting piece 3 formed within the cut 1C is made by giving no damage to resilience of the pick body 1 (see FIG. 3). That is, resilience of the base end portion 1B together with that of the cut 1C is maintained as the pick body is fixed by connecting the end portion of the belt body 2 to the connecting piece 3.

A connecting hook 3A is projected on the inside of the bent end portion side of the illustrated connecting piece 3, and a connecting opening 2A of the belt body 2 is connected to the connecting hook 3A (see FIG. 2). Such connecting structure is not limited to the illustrated example, but any one that can fix the belt body 2.

Figure 4:
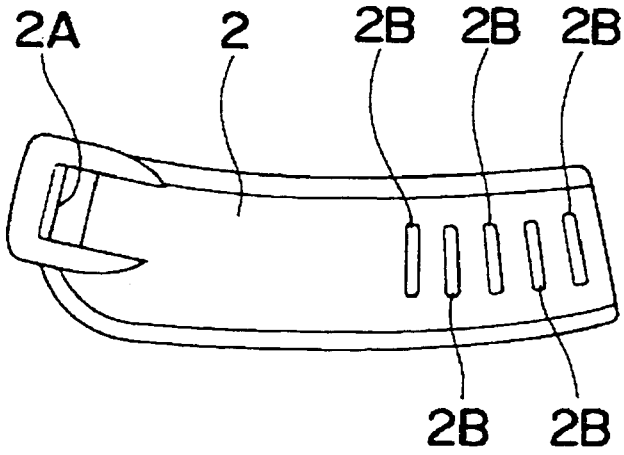
FIG. 4 is a plan view of the belt body.

On the other hand, at the end of the base end portion of the pick body 1 is formed a bent portion 1D along the side face of the thumb, and at the end of the bent portion 1D is protruded an engaging protrusion 4 (see FIG. 4). The bent portion 1D lessens influence on operation of the belt body 2 connected to the end portion of the pick body 1. That is, operation of the flat face of the base end portion 1B is not disturbed by connecting the belt body 2 to the engaging protrusion 4 protruded from the end of the bent portion 1D.

The illustrated engaging protrusion 4 forms a hook, and the end portion of the belt body 2 is adjustably connected to the engaging protrusion 4. The engaging protrusion 4 is not limited to the illustrated example, but any proper engaging means can be adopted.

The belt body 2 is fixed by winding the pick body 1 round the thumb, in which the connecting opening 2A provided at one end of the belt body 2 is connected to the connecting piece 3 of the pick body 1, and the plurality of the adjusting opening 2B provided at the other end is engaged to the engaging protrusion 4 of the pick body 1 (see FIG. 4). The adjusting opening 2B comprises a plurality of openings along the longitudinal direction of the belt body 2, and length of the belt body 2 is adjusted by selecting the position of this opening. Further, as illustrated, a plurality of the opening is disposed for obtaining an advantage of delicately adjusting clamping strength by the developed condition of these openings.

Further, after adjusting the optimum length, unnecessary portions of the belt body 2 are cut off, and the thumb pick can be used as the one most suitable for a player. Further, the shapes and detailed constructions of the pick body 1 and the belt body 2 are not limited to the illustrated examples, but can freely be changed.

As explained above, according of the thumb pick of the present invention, the belt body 2 is separately formed from the pick body 1, and both end portions of the belt body 2 are adjustably connected to the pick body 1, so that such disadvantage that the position of the thumb pick is displaced by heat generation and perspiration of fingers during a performance. Further, the material suitable for the pick body 1 and that suitable for the belt body 2 are selected, respectively, and each performer can use the optimum material as a thumb pick as he likes.

Further, there is provided the cut 1C bent from the protruded portion 1A to the base end portion 1B of the pick body 1, and the substantially tongue-shaped connecting piece 3 formed within the cut 1C is detachably connected to one end portion of the belt body 2, so that even if the pick body 1 is fixed to the belt body 2, elasticity of the protruded portion 1A and the base end portion 1B of the pick body 1 is not spoiled, and the elasticity of the whole pick body 1 can be used for a performance.

Further, as the bent portion 1D along the side face of the thumb is formed at the end of the base end portion of the pick body 1, the engaging protrusion 4 is provided by protruding from the end portion of the bent portion 1D, and the end portion of the belt body 2 is adjustably connected to the engaging protrusion 4, the optimum mounting suitable for the finger of a performer becomes possible.

As a result, even with long use, a disadvantage of hurting the finger is dissolved.

Further, as the engaging protrusion 4 is protruded from the bent portion 1D of the pick body 1, and the belt body 2 is connected to the engaging protrusion 4, the belt body 2 does not disturb an operation of the strings by the base end portion 1B of the pick body 1, and it can be handled in the same manner as the conventional thumb pick, and any picking suitable for each kind of performing method becomes possible.

What is claimed is:

1. A thumb pick for a guitar, comprising:

a pick body, comprising a base end portion configured to contact a thumb, and a protrusion portion integrally extending from the base end portion and configured for picking strings;

a belt body, separate from the pick body, which fixes the pick body to the thumb, wherein two end portions of the belt body adjustably connect to the pick body;

a cut-out portion extending from the protrusion portion to the base end portion; and a tongue provided inside the cut-out portion, an end portion of the belt body detachably connecting to the tongue.

2. A thumb pick for a guitar, comprising:

a pick body, comprising a base end portion configured to contact a thumb, and a protrusion portion integrally extending from the base end portion and configured for picking strings;

a belt body, separate from the pick body, which fixes the pick body to the thumb, wherein two end portions of the belt body adjustably connect to the pick body;

a curved portion formed at an end of the base portion and configured to contact a side of the thumb; and an engaging portion protruding from the curved portion, an end portion of the belt body adjustably connecting to the engaging portion and comprising a plurality of slits configured to engage the engaging portion.

3. A thumb pick for a guitar of claim 1, further comprising a curved portion formed at an end of the base portion and configured to contact a side of the thumb, and an engaging portion protruding from the curved portion, an end portion of the belt body adjustably connecting to the engaging portion.

4. A thumb pick for a guitar of claim 3, wherein an end portion of the belt body comprises a plurality of slits configured to engage the engaging portion.

5. The thumb pick for a guitar of claim 1, wherein perforations are formed in the pick body, arranged in a pair of lines extending from the cut-out portion, which are configured to allow an extension of the cut-out portion.

6. The thumb pick for a guitar of claim 1, wherein an end of the tongue comprises a hook, to which an end portion of the belt body detachably connects.

7. The thumb pick for a guitar of claim 2, wherein the engaging portion comprises a hook, to which an end portion of the belt body detachable connects.

8. The thumb pick for a guitar of claim 3, wherein the engaging portion comprises a hook, to which an end portion of the belt body detachable connects.

* * * * *